US005742124A

United States Patent [19]

Kees et al.

[11] Patent Number: 5,742,124

[45] Date of Patent: Apr. 21, 1998

[54] HIGH-PRESSURE DISCHARGE LAMP

[75] Inventors: Antonie H. M. Kees, Uden; Martinus J. M. Kessels, Eindhoven, both of Netherlands; Fransiscus H. Van Lierop, Bath, N.Y.

[73] Assignee: U.S. Phillips Corporation, New York, N.Y.

[21] Appl. No.: 613,934

[22] Filed: Mar. 11, 1996

[30] Foreign Application Priority Data

Mar. 9, 1995 [EP] European Pat. Off. ..... 95200576

[51] Int. Cl.[6] ..... H01J 17/16

[52] U.S. Cl. ..... 313/625; 313/624

[58] Field of Search ..... 313/625, 624, 313/623, 573, 634, 636, 354

[56] References Cited

U.S. PATENT DOCUMENTS 4,034,252 7/1977 McVey ..... 313/625
4,475,061 10/1984 Van De Weijer et al. ..... 313/625 X
4,940,433 7/1990 Jacobs et al. ..... 313/631
5,424,608 6/1995 Juengst et al. ..... 313/625 X

FOREIGN PATENT DOCUMENTS

0587238A1 3/1994 European Pat. Off. ..... H01J 63/36
0209259 11/1984 Japan ..... 313/625

*Primary Examiner*—Ashok Patel
*Attorney, Agent, or Firm*—Walter M. Egbert, III

[57] ABSTRACT

The invention relates to a high-pressure discharge lamp provided with a discharge vessel which encloses a discharge space, which has a ceramic wall, and which is sealed at one end by means of a projecting ceramic plug which encloses with clearance a current supply conductor to an electrode arranged in the discharge vessel and is connected to said conductor adjacent an end facing away from the discharge space in a gastight manner by means of a melting-ceramic connection. According to the invention, at least an end portion of the ceramic plug situated near the end facing away from the discharge space is impermeable to light.

19 Claims, 1 Drawing Sheet

HIGH-PRESSURE DISCHARGE LAMP

BACKGROUND OF THE INVENTION

The invention relates to a high-pressure discharge lamp provided with a discharge vessel which encloses a discharge space, has a ceramic wall, and is sealed at one end by means of a projecting ceramic plug which encloses with clearance a current lead-through to an electrode arranged in the discharge vessel and is connected to said lead-through in a gastight manner by means of a melting-ceramic connection at an end facing away from the discharge space.

A lamp of the kind mentioned in the opening paragraph in the form of a high-pressure sodium lamp is known from GB 2 083 692/U.S. Pat. No. 4,910,433, and in the form of a metal halide lamp from EP 0 587 238.

A ceramic wall or plug in the present description and claims is understood to be made of one of the following materials: monocrystalline metal oxide (for example, sapphire), densely sintered polycrystalline metal oxide (for example, $Al_2O_3$, YAG), and polycrystalline densely sintered metal nitride (for example, AlN).

The chosen construction is highly suitable for lamps of comparatively low power and correspondingly comparatively small dimensions, in particular having a comparatively small electrode interspacing. To prevent excessively high temperatures at the area of the melting-ceramic connection during lamp operation, the seal of the discharge vessel is constructed as a projecting plug, and the melting-ceramic connection is realised near an end of the projecting plug which faces away from the discharge space.

The melting-ceramic connection between the projecting plug and the current lead-through is achieved in a furnace in a firing process. For this purpose, the projecting plug and the current lead-through are heated together with a quantity of melting-ceramic, so that the ceramic material melts and flows into the interspacing between the projecting plug and current lead-through. The assembly is then cooled down to room temperature, and the connection between the projecting plug and current lead-through has been achieved. This is the so-called sealing-in procedure.

The distance over which the melting-ceramic flows in the interspacing determines the length over which the gastight melting-ceramic connection extends. The length of the melting-ceramic connection is of major importance for realising a lamp of quality. Given a length smaller than 1 mm, a comparatively weak mechanical joint has arisen with a considerable risk of a premature lamp failure.

Given a comparatively great length, the surface area of the melting-ceramic connection facing the discharge space will reach a considerably higher temperature during lamp operation than is desirable. The results of this are attacks on the melting-ceramic connection by filling ingredients of the discharge vessel and the changes in photometric properties arising therefrom (for example, colour of emitted radiation, luminous efficacy) of the lamp. This, also, will often lead to a premature end of lamp life.

Lamp manufacture on an industrial scale involves batch production. The production of the known lamp shows a wide spread in the length over which the melting-ceramic connection extends. This already leads to a high reject percentage in manufacture.

SUMMARY OF THE INVENTION

The invention has for its object to provide a measure for improving the control of the length of the melting-ceramic connection. To be a lamp according to the invention, therefore, the lamp mentioned in the opening paragraph is characterized in that at least an end portion of the projecting ceramic plug adjacent the end facing away from the discharge space is impermeable to light.

It was found that a high reproducibility of the flowing distance of the melting-ceramic can be realised during the sealing-in procedure, and thus of the length of the achieved gastight ceramic connection. According to the inventor, this is to be ascribed to an increased infrared absorption of the end portion of the projecting plug which is impermeable to light. This leads to a more homogeneous heating during the sealing-in procedure of both the projecting plug and the flowing ceramic material, which again leads to a better control of the length of the melting-ceramic connection through time control of the sealing-in procedure.

An important advantage of the invention is that a comparatively simple measure in the form of a pretreatment during component manufacture can suffice, while the existing lamp manufacturing technology, in particular the sealing-in procedure, can be maintained without modifications.

The end portion which is impermeable to light extends over a distance of at least 1 mm, preferably over a distance of at least 3 mm. This has the advantage that an even heating takes place during the sealing-in procedure over the entire length of the melting-ceramic connection to be realised.

It is advantageous for a simple production of the projecting ceramic plug that the latter is impermeable to light over its entire length. The duration of the sealing-in procedure may be reduced owing to the strongly improved heat absorption caused thereby in the sealing-in process. This is an important advantage especially in batch production.

The projecting ceramic plug may be impermeable to light owing to an externally provided coating, for example in the form of Mo, W or C. The coating may be realised through vapour deposition, chemical vapour deposition, brushing (for example, with a W rod), or immersion in a solution (for example, molybdate) of a previously fired, but not yet sintered moulded piece which will form the projecting plug after sintering. A further possibility is to dose the moulded piece with a viscous solution (for example, molybdate), which method is also called painting.

Another possibility of obtaining a projecting plug impermeable to light is the manufacture of the projecting plug from non-translucent ceramic material. This is possible, for example, in that the ceramic material is impregnated with optical centers, for example Fe, Cr, Ni, during its manufacture.

BRIEF DESCRIPTION OF THE DRAWINGS

The above and other aspects of the invention will be explained in more detail with reference to a drawing of an embodiment of a lamp according to the invention, in which FIG. 1 diagrammatically shows a lamp according to the invention.

DESCRIPTION OF THE PREFERRED EMBODIMENTS

Figure 1:
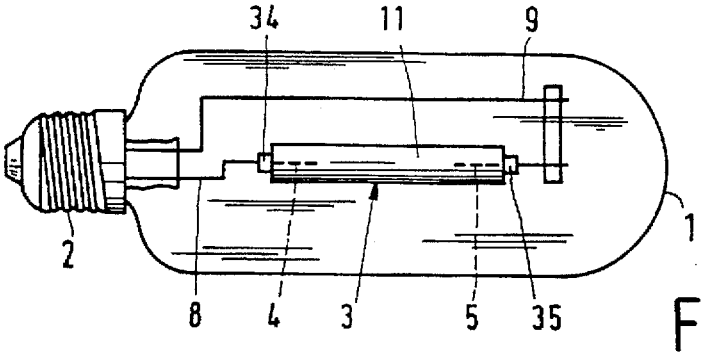
Figure 2:
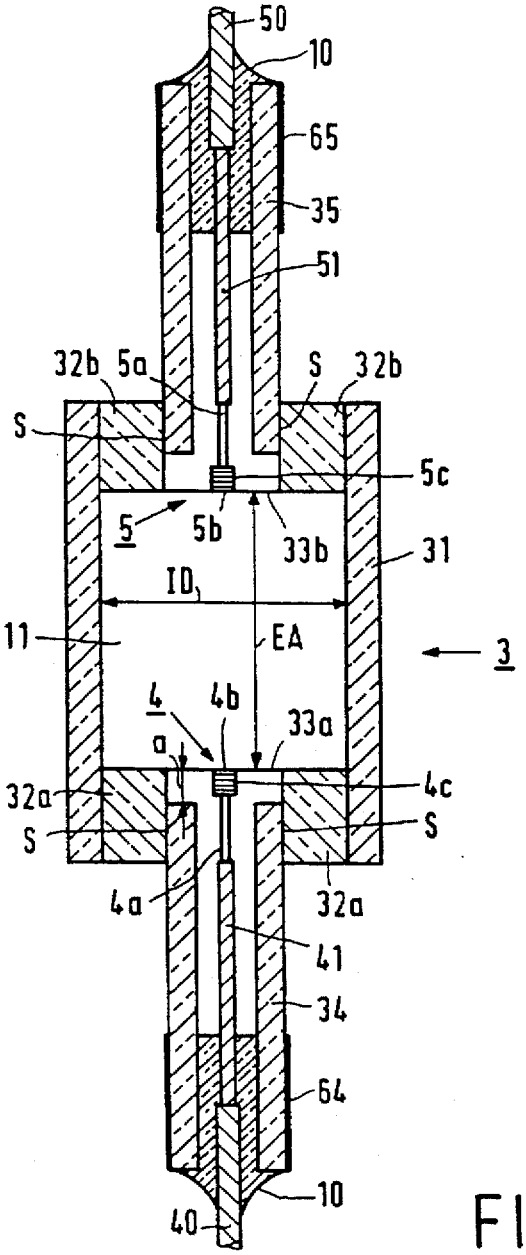
FIG. 2 shows the discharge vessel of the lamp of FIG. 1 in detail.

FIG. 1 shows a high-pressure discharge lamp provided with a discharge vessel 3 with a ceramic wall enclosing a discharge space 11. In a practical embodiment, the discharge vessel contains a filling which comprises besides Hg and a rare gas at least also a metal halide. The discharge vessel is sealed at an end by means of a projecting ceramic plug 34, 35 which encloses with clearance a current lead-through (FIG. 2: 40, 41, 50, 51) to an electrode 4, 5 arranged in the discharge vessel, and which is connected to said lead-through in a gaslight manner by means of a melting-ceramic connection (FIG. 2: 10) adjacent an end facing away from the discharge space. The discharge vessel is surrounded by an outer bulb 1 which is provided with a lamp cap 2 at one end. A discharge extends between the electrodes 4, 5 in the operational condition of the lamp. Electrode 4 is connected to a first electrical contact forming part of the lamp cap 2 via a current conductor 8. Electrode 5 is connected to a second electrical contact forming part of the lamp cap 2 via a current conductor 9. The discharge vessel, shown in more detail in FIG. 2 (not true to scale), has a ceramic wall and is formed by a cylindrical portion with an internal diameter ID bounded at either end by end wall portions 32*a*, 32*b*, each end wall portion 32*a*, 32*b* defining an end plane 33*a*, 33*b* of the discharge space. The end wall portions each have an opening in which a projecting ceramic plug 34, 35 is fastened in the end wall portion 32*a*, 32*b* in a gastight manner by means of a sintered joint S. The projecting ceramic plugs 34, 35 each enclose with clearance a current lead-through 40, 41, 50, 51 to an associated electrode 4, 5 having a tip 4*b*, 5*b*. The current lead-through is connected to the projecting ceramic plug 34, 35 in a gastight manner at a side facing away from the discharge space by means of a melting-ceramic connection 10. The projecting ceramic plugs are provided with a coating 64, 65 at their ends facing away from the discharge space, so that the projecting plugs are impermeable to light. The length over which an end portion of each of the projecting plugs is impermeable to light is 3 mm. The electrode tips 4*b*, 5*b* have an interspacing EA. The current lead-throughs each comprise a halide-resistant portion 41, 51, for example in the form of a Mo—$Al_2O_3$ cermet, and a portion 40, 50 fastened to an associated end plug 34, 35 in a gastight manner by means of the melting-ceramic connection 10. The melting-ceramic connection 10 extends over a certain distance, for example approximately 1 mm, over the Mo cermet 41, 51. It is possible for the parts 41, 51 to be formed in a manner other than from a Mo—$Al_2O_3$ cermet. Other possible constructions are known from, for example, EP-0 587 238. A halide-resistant coil wound around a halide-resistant pin was among the constructions which were found to be particularly suitable. Mo is very suitable for use as a halide-resistant material. The parts 40, 50 are made of a metal which has a coefficient of expansion which corresponds closely to that of the end plugs. Nb, for example, was found to be a very suitable material. The parts 40, 50 are connected to the current conductors 8, 9 in a manner which is not shown in any detail. The lead-through construction described renders it possible to operate the lamp in any burning position as desired.

Each of the electrodes 4, 5 comprises an electrode rod 4*a*, 5*a* which is provided with a winding 4*c*, 5*c* near the tip 4*b*, 5*b*. The electrode tips in the embodiment described lie substantially in the end planes 33*a*, 33*b* formed by the end wall portions.

The projecting ceramic plugs are provided so as to be recessed by a distance a relative to the end wall portions 32*a* and 32*b*, and are fastened therein in a gastight manner with a sintered joint S. In an alternative embodiment of the lamp according to the invention, the projecting ceramic plugs 34, 35 are provided without recess relative to the end wall portions 32*a*, 32*b*. In that case, the electrode tips lie between the end planes defined by the end wall portions.

In a practical embodiment of a lamp according to the invention as shown in the drawing, the rated power of the lamp is 70 W. The filling of the discharge vessel is 4.4 mg Hg and 8 mg NaI, TlI and $(Dy+Ho+Tm)I_3$ in a mass ratio of 65:10:25. In addition, the lamp contains Ar as an ignition gas. The lamp is designed for a colour temperature of 3000K with colour point coordinates (x,y; 437,404) and a general colour rendering index Ra above 80. The discharge vessel is made of polycrystalline aluminium oxide, has an internal diameter ID of 6.85 mm and an interspacing between the electrode tips EA of 7 mm. The projecting plugs are impermeable to light at the ends facing away from the discharge space over a length of 3 mm owing to a coating with W. The coating is realised in that the moulded piece is brushed with a W-brush, after which the moulded piece is sintered to achieve gastightness. The projecting plugs are sintered into the end wall portions at a distance a of 1 mm from the end planes defined by the end wall portions. The end wall portions have a height of 3 mm, so that the sintered joint with the end plugs extends over a length of 2 mm. Such a length of the sintered joint was found to be sufficient in practice for realising a sufficiently strong and gastight fastening between the end wall portion and the projecting plug, also in the case of large-scale batch production. The electrode tips lie in the end planes. The electrodes each comprise a W-rod provided with a W-winding at the tip.

Subsequently, a gastight melting-ceramic connection is formed between each projecting ceramic plug and an associated current supply conductor in known manner.

The melting-ceramic connection 10 extends over a length of 3 to 3.5 mm away from the end of the projecting plug facing away from the discharge space.

For comparison, data are given of lamps according to the present art. Here the length over which the melting-ceramic connection extends between the projecting plug and current lead-through varies from 3 to 7.5 mm, while in a number of cases the length cannot be unequivocally ascertained because the flowing distance of the melting-ceramic varies along the circumference of the current lead-through.

In a further practical embodiment of the lamp as drawn, the coating is realised with Mo. For this purpose, the previously moulded projecting plugs were immersed with one end in an aqueous solution of $Na_2MoO_4$ and glycerine. After drying, the projecting plugs were sintered to gastightness ,and simultaneously sintered to the end wall portions. A gastight melting-ceramic connection between the projecting ceramic plug and the associated current lead-through realised in the same way as for the lamp provided with a W-coating on the projecting ceramic plugs led to a comparable end result.

We claim:

1. A high-pressure discharge lamp which comprises a discharge vessel enclosing a discharge space, having a ceramic wall and a projecting ceramic plug, the discharge vessel being sealed at one end by means of said projecting ceramic plug which encloses with clearance a current lead-through to an electrode arranged in the discharge vessel and is connected to said lead-through in a gastight manner by means of a melting-ceramic connection at an end facing away from the discharge space, characterized in that: the projecting ceramic plug comprising means for rendering at least an end portion of the projecting ceramic plug adjacent the end facing away from the discharge space impermeable to light.

2. A lamp as claimed in claim 1, characterized in that the projecting ceramic plug is impervious to light over a distance of at least 1 mm measured from the end facing away from the discharge space.

3. A lamp as claimed in claim 2, characterized in that the projecting ceramic plug is impervious to light over a distance of at least 3 mm measured from the end facing away from the discharge space.

4. A lamp as claimed in claim 3, characterized in that the projecting ceramic plug is impervious to light over its entire length.

5. A lamp as claimed in claim 4, characterized in that said means for rendering the projecting plug impervious to light is an external coating provided on said projecting plug.

6. A lamp as claimed in claim 4, characterized in that the projecting plug is manufactured from a ceramic material which is impervious to light.

7. A lamp as claimed in claim 6, characterized in that said means for rendering the projecting ceramic plug impervious to light are optical centers impregnated in said projecting ceramic plug.

8. A lamp as claimed in claim 3, characterized in that the projecting plug is manufactured from a ceramic material which is impervious to light.

9. A lamp as claimed in claim 2, characterized in that the projecting plug is manufactured from a ceramic material which is impervious to light.

10. A lamp as claimed in claim 1, characterized in that the projecting plug is manufactured from a ceramic material which is impervious to light.

11. A lamp as claimed in claim 3, characterized said means for rendering the projecting plug impervious to light is an external coating provided on said projecting plug.

12. A lamp as claimed in claim 2, characterized in that said means for rendering the projecting plug impervious to light is an external coating provided on said projecting plug.

13. A lamp as claimed in claim 1, characterized in that said means for rendering the projecting plug impervious to light is an external coating provided on said projecting plug.

14. A lamp as claimed in claim 2, characterized in that the projecting ceramic plug is impervious to light over its entire length.

15. A lamp as claimed in claim 14, characterized in that the projecting plug is provided with an external coating.

16. A lamp as claimed in claim 14, characterized in that the projecting plug is manufactured from a ceramic material which is impervious to light.

17. A lamp as claimed in claim 1, characterized in that the projecting ceramic plug is impervious to light over its entire length.

18. A lamp as claimed in claim 14, characterized in that the projecting plug is provided with an external coating.

19. A lamp as claimed in claim 17, characterized in that the projecting plug is manufactured from a ceramic material which is impervious to light.

* * * * *